US007793790B2

(12) United States Patent
Lee

(10) Patent No.: US 7,793,790 B2
(45) Date of Patent: Sep. 14, 2010

(54) DISH WASHER

(75) Inventor: Yong Jae Lee, Woolsan-si (KR)

(73) Assignee: LG Electronics Inc., Seoul (KR)

( * ) Notice: Subject to any disclaimer, the term of this patent is extended or adjusted under 35 U.S.C. 154(b) by 603 days.

(21) Appl. No.: 11/377,640

(22) Filed: Mar. 17, 2006

(65) Prior Publication Data

US 2006/0254993 A1 Nov. 16, 2006

(30) Foreign Application Priority Data

Mar. 17, 2005 (KR) ..... 10-2005-0022439

(51) Int. Cl.
*A47G 19/08* (2006.01)

(52) U.S. Cl. ..... 211/41.9

(58) Field of Classification Search ..... 211/74, 211/41.8, 41.9, 12, 85.15, 181.1; 220/488; 134/135, 177
See application file for complete search history.

(56) References Cited

U.S. PATENT DOCUMENTS 542,734 A * 7/1895 Johnson ..... 211/41.4
1,562,614 A * 11/1925 Blakeslee ..... 211/41.8
1,853,888 A * 4/1932 Williams ..... 211/41.1
2,655,267 A * 10/1953 Planeta ..... 211/74
3,451,556 A 6/1969 Macoicz
4,046,261 A * 9/1977 Yake ..... 211/41.8
4,577,764 A * 3/1986 Silka et al. ..... 211/41.4
4,606,464 A * 8/1986 Jordan et al. ..... 211/41.8
4,909,401 A * 3/1990 McConnell ..... 211/74
4,927,033 A * 5/1990 Patera et al. ..... 211/41.9
5,158,185 A * 10/1992 Michael et al. ..... 211/41.8
5,351,837 A * 10/1994 Smith ..... 211/41.8
5,405,018 A * 4/1995 Anthrop, Jr. ..... 211/41.9
6,012,593 A * 1/2000 Knittel et al. ..... 211/41.11
2003/0168417 A1* 9/2003 Morgan ..... 211/41.11

FOREIGN PATENT DOCUMENTS

DE 29821434 U1 7/1999

* cited by examiner

*Primary Examiner*—Jennifer E. Novosad
(74) *Attorney, Agent, or Firm*—McKenna Long & Aldridge LLP

(57) ABSTRACT

Provided is a dishwasher. The dishwasher includes a dish rack receiving articles and a bottle rack. The bottle rack includes a rack body detachably coupled to the dish rack and one or more bottle tines coupled to a top portion of the rack body, for receiving articles having a bottle or cup shape.

16 Claims, 4 Drawing Sheets

DISH WASHER

This application claims priority to Korean Application No. 10-2005-0022439 filed on Mar. 17, 2005, of which is incorporated by reference, as if fully set forth herein.

BACKGROUND OF THE INVENTION

1. Field of the Invention

The present invention relates to a dishwasher, and more particularly, to a dishwasher provided with a bottle rack for receiving tableware having a hollow cylindrical shape such as milk bottles and feeding bottles at a desired location on a dish rack.

2. Description of the Related Art

A dishwasher is a device that removes foreign substances such as remaining food and dirt from dishes by injecting washing liquid at a high pressure through an injection nozzle.

In detail, a dishwasher includes a tub forming a washing chamber and a sump installed under the tub for storing washing liquid. The washing liquid is pushed to an injection nozzle by a washing pump installed in the sump, and then injected at a high pressure through an injection aperture formed in an end of the injection nozzle. The injected washing liquid removes dirt such as remaining food from dishes by colliding with the dishes. The removed dirt drops to a bottom of the tub.

The dishwasher further includes at least one dish rack for receiving dishes. Generally, two dish racks are detachably installed in the tub at upper and lower positions.

Generally, tableware products having a long, hollow shape such as milk bottles and feeding bottles are put on the dish rack in a laid down position.

However, if the long, hollow tableware products are put on the dish rack in a laid down position, the tableware products are not cleanly washed since washing liquid is not effectively injected into the table products. Therefore, long, hollow tableware products such as bottles must be placed upside-down on the dish rack.

However, the dish rack of the related art does not have a structure for placing tableware products such as bottles in an upside-down position.

Further, although milk bottles or feeding bottles are relatively small, they are long. Therefore, other tableware products are not efficiently placed on the dish rack by the milk bottles and the feed bottles, such that the space of the dish rack cannot be efficiently used.

SUMMARY OF THE INVENTION

Accordingly, the present invention is directed to a dishwasher that substantially obviates one or more problems due to limitations and disadvantages of the related art.

An object of the present invention is to provide a dishwasher with a bottle rack for separately placing tableware products having a hollow shape such as milk bottles and feeding bottles in a vertical position.

Another object of the present invention is to provide a dishwasher with a bottle rack for placing tableware products at a desired location of a dish rack according to the number of the tableware products.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher including: a dish rack receiving articles; and a bottle rack including a rack body detachably coupled to the dish rack and one or more bottle tines coupled to a top portion of the rack body, for receiving articles having a bottle or cup shape.

In another aspect of the present invention, there is provided a dishwasher including: a dish rack including an outer frame and an accommodation frame coupled to the outer frame for forming a bottom surface of the dish rack; and a bottle rack detachably coupled to a bottom surface of the accommodation frame for vertically receiving articles having a bottle or cup shape, wherein the bottle rack includes a rack body forming an exterior of the bottle rack and a bottle tine having both ends coupled to a top portion of the rack body.

In a further another aspect of the present invention, there is provided a dishwasher including: a dish rack including an outer frame forming an exterior of the dish rack and an accommodation frame coupled to the outer frame for forming a bottom surface of the dish rack; and a bottle rack detachably coupled to the accommodation frame for vertically receiving articles having a bottle or cup shape, wherein the bottle rack includes a rack body having a frame inserting groove for receiving the accommodation frame, and a bottle tine extendably coupled to a top portion of the rack body.

According to the dishwasher of the present invention, tableware products having a hollow shape such as milk bottles and feeding bottles can be separately placed on the dish rack in a vertical position.

Further, the space of the dish rack can be more efficiently used by vertically placing hollow tableware products on the dish rack.

Furthermore, since the bottle rack is detachably mounted on the dish rack, dishes or bottles can be placed on the dish rack at desired locations.

In addition, since long and hollow tableware products such as milk bottles and feeding bottles are placed upside-down on the dish rack, remainders or dirt can be completely removed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
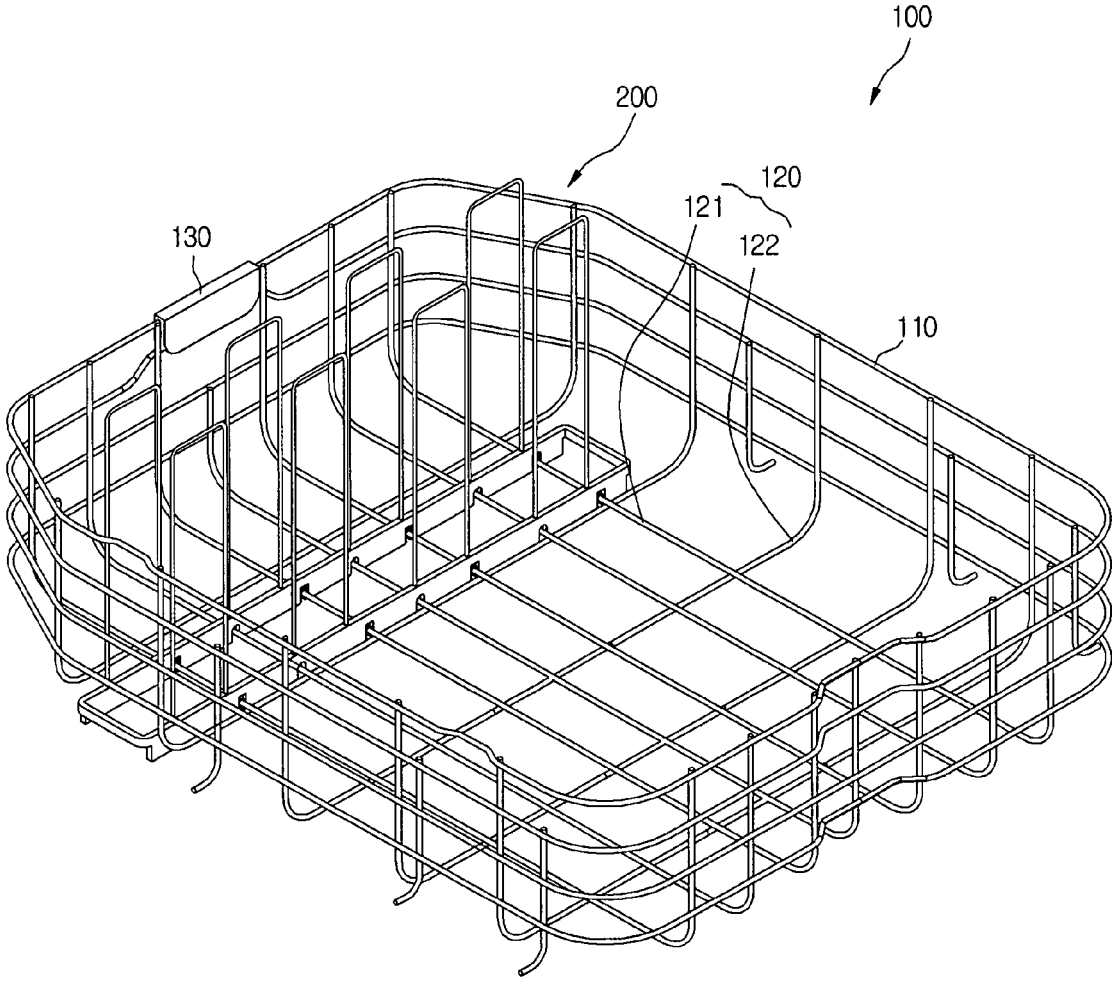
FIG. 1 is a perspective view of a dish rack provided with a bottle rack according to the present invention.

FIG. 1 is a perspective view of a dish rack provided with a bottle rack according to the present invention.

Referring to FIG. 1, a dish rack 100 of the present invention includes an outer frame 110 forming the exterior of the dish rack 100 and an accommodation frame 120 having both ends coupled to the outer frame 110. The accommodation frame 120 is bent into a U shape to form a bottom portion of the dish rack 100.

A bottle rack 200 is mounted on an inner position of the dish rack 100 for receiving tableware such as a bottle.

In detail, the outer frame 110 includes bars that are uniformly and vertically arranged. The accommodation frame 120 includes bars bonded to an inner portion of the outer frame 110 at a uniform interval. The accommodation frame 120 includes a rack column frame 121 and a rack row frame 122. The rack column frame 121 has one end coupled to a front portion of the outer frame 110 and the other end coupled to a back portion of the outer frame 110. The rack row frame 122 has one end coupled to a left side of the outer frame 110 and the other end coupled to a right side of the outer frame 110.

The outer frame 110 includes a grip 130 on a front or upper portion. A user can easily pull and push the dish rack 100 using the grip 130.

The above-described structure allows a user to put dishes in the dish rack 100 and push the dish rack 100 into a tub of a dishwasher. The bottle rack 200 of the present invention can be mounted on one side of the outer frame 110. Since the outer frame 110 and the accommodation frame 120 of the dish rack 100 are formed of the bars having a predetermined diameter and bent several times, washing liquid injected onto dishes can fall rapidly to a bottom surface of the tub through the outer frame 110 and the accommodation frame 120.

The bottle rack 200 is detachably mounted on the dish rack 100. Therefore, the mounting position of the bottle rack 200 can be changed according to the type and number of dishes to be placed on the dish rack 100.

The bottle rack 200 mounted on the dish rack 100 will now be more fully described with reference to FIG. 2.

Figure 2:
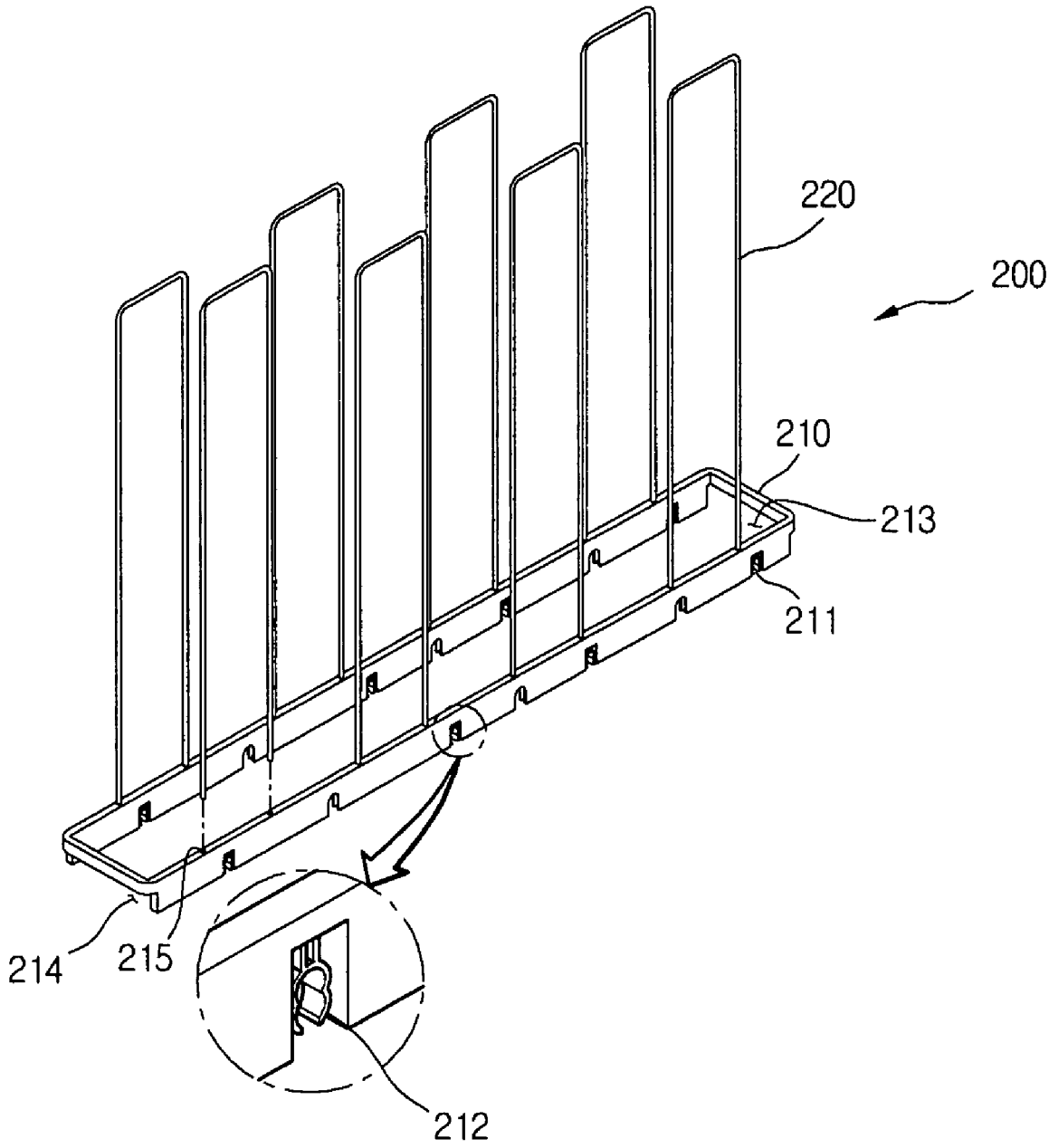
FIG. 2 is a perspective view of the bottle rack depicted in FIG. 1.
Figure 3:
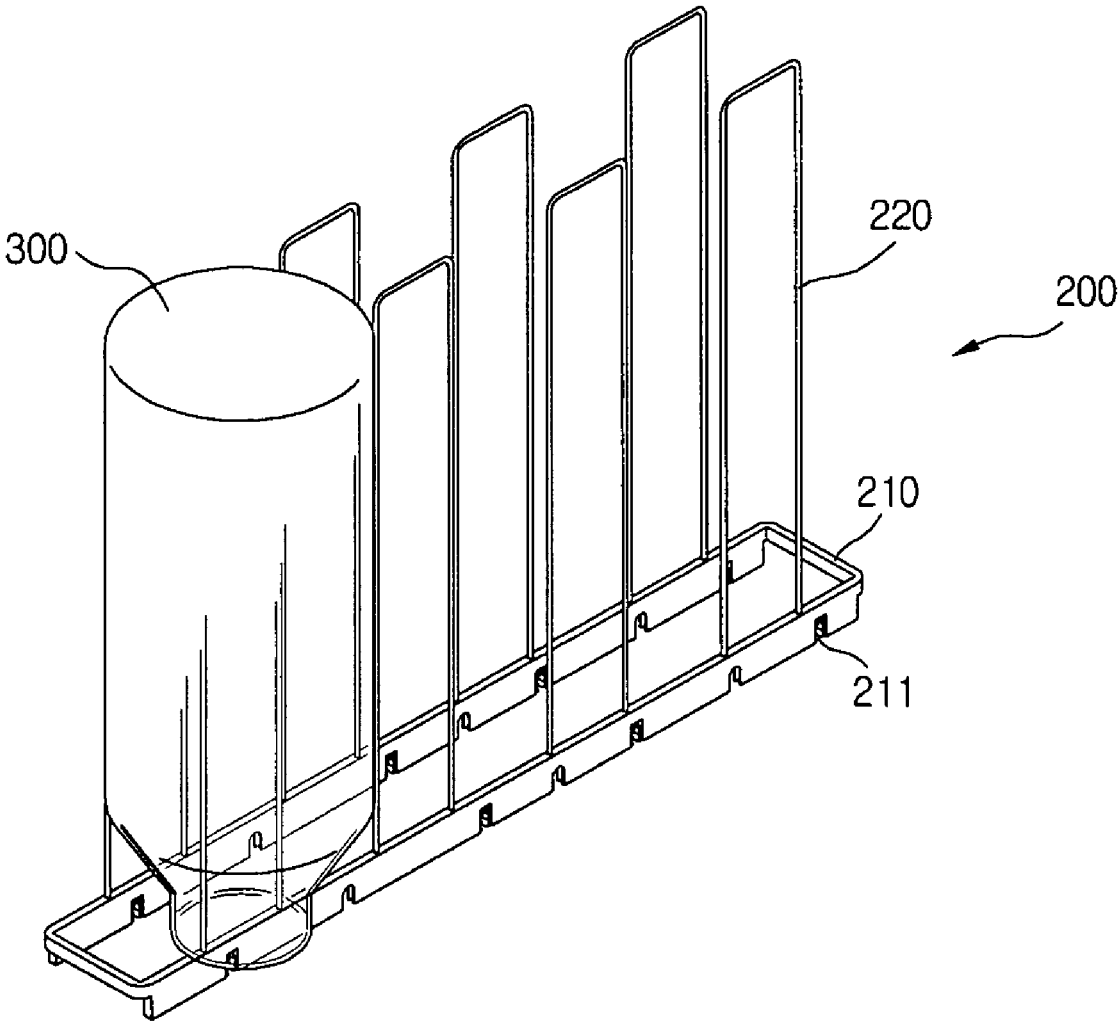
FIG. 3 is a perspective view of the bottle rack of FIG. 1 when a tableware product having a bottle or cup shape is put on the bottle rack.

FIG. 2 is a perspective view of the bottle rack depicted in FIG. 1, and FIG. 3 is a perspective view of the bottle rack when a tableware product having a bottle or cup shape is put on the bottle rack.

Referring to FIGS. 2 and 3, the bottle rack 200 can be detachably and movably mounted on the rack column frame 121 of the dish rack 100.

In detail, the bottle rack 200 includes a rack body 210 and bottle tines 220 detachably coupled to a top surface of the bottle body 210 for receiving bottles.

In more detail, the rack body 210 includes at least two long surfaces and short surfaces. For example, the rack body 210 has a rectangular box shape. The rack body 210 may be formed of plastic by injection molding. However, the rack body 210 can be formed of different materials into different shapes according to the present invention.

The rack body 210 further includes one or more frame inserting grooves 211 in a bottom surface for coupling with the rack column frame 121 of the accommodation frame 120. The frame inserting grooves 211 are formed in the bottom surface of the rack body 210 at the same interval as the bars of the accommodation frame 120.

Therefore, the bottle tines 220 can be located at desired positions on the bottom surface of the dish rack 100.

Further, symmetric fixing parts 212 are respectively formed in the frame inserting grooves 211 for fixing the rack body 210 to the accommodation frame 120. Each of the fixing parts 212 has a shape corresponding to the bars of the accommodation frame 120. Therefore, when the rack body 200 is mounted on the accommodation frame 120, the position of the rack body 210 can be fixed. The fixing part 212 is snap fitted around the bar of frame 120. That is, the rack body 210 is coupled to the accommodation frame 120 by snap fitting using the fixing part 212.

The rack body 210 further includes an outlet hole 213 allowing outflow of washing liquid. Therefore, washing liquid fallen from dishes can reach the bottom of the tub easily owing to the outlet hole 213.

The rack body 210 further includes one or more insertion grooves 215 in a top portion for receiving ends of the bottle tines 220. The bottle tines 220 are mounted on the long surfaces of the rack body 210. That is, the bottle tines 220 are mounted on the rack body 210 in at least two rows.

Each of the bottle tines 220 is formed into a rod shape having a predetermined diameter and bent several times. The bottle tine 220 may be formed of a rigid material, or it may be formed of plastic by injection molding. Further, the width of the bottle tine 220 is smaller than the inner diameter of a bottle such as a milk bottle and a feeding bottle to be received by the bottle rack 200. Therefore, the bottle tine 220 can be easily inserted into the bottle.

In the embodiment shown in FIG. 2, the bottle tines 220 are mounted on each of the long surfaces of the rack body 210 in a row. However, the bottle tines 220 can be mounted on the rack body 210 in a different way. For example, one end of the bottle tine 220 may be mounted on one of the long surfaces of the rack body 210, and the other end of the bottle tine 220 may be mounted on the other of the long surfaces of the rack body 210.

Interference preventing grooves 214 are formed in both sides of the rack body 210. Owing to the interference preventing grooves 214, the bottle rack 200 can be stably mounted on bars of the accommodation frame 120 arranged in one direction without interference with other bars of the accommodation frame 120 arranged in the other direction.

In the above-described structure of the bottle rack 200, a desired number of bottle tines 220 are inserted into the insertion grooves 215 formed in the top surface of the rack body 210. Next, the rack body 210 is depressed toward the rack column frame 121 in order to insert the bars of the rack column frame 121 into the frame inserting grooves 211 formed in the bottom surface of the rack body 210. Then, a bottle 300 such as a milk bottle and a feeding bottle is placed on the bottle rack 200 by inserting the bottle tine 220 into the bottle 300 through an opened top of the bottle 300. That is, the bottle 300 is placed with its top facing downward. Therefore, the space of the dish rack 100 can be more efficiently used since the bottle 300 can be vertically placed on the dish rack 100.

Figure 4:
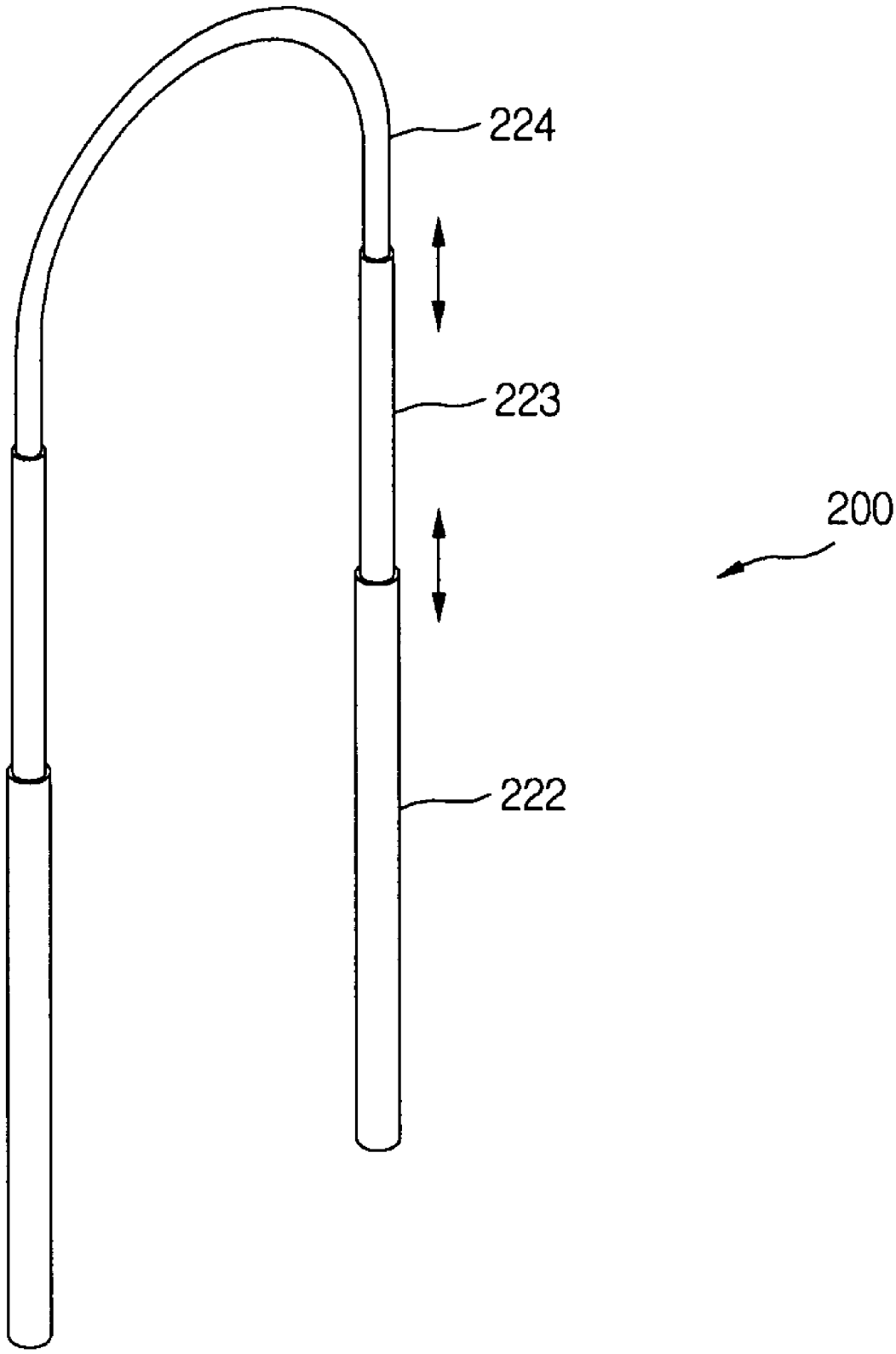
FIG. 4 is a perspective view of a bottle tine according to the present invention.

FIG. 4 is a perspective view of the bottle tine according to the present invention.

Referring to FIG. 4, the bottle tine 220 is characterized by extendable configuration.

In detail, the bottle tine 220 includes a pair of tine bodies 222, extensions 223, and a bent part 224. When assembled, the tine bodies 222 are mounted on the rack body 210. The extensions 223 have an outer diameter corresponding to an inner diameter of the tine bodies 222 and are extendable from the tine bodies 222. The bent part 224 has an outer diameter corresponding to an inner diameter of the extensions 223.

In more detail, the extensions 223 can move into and extend from the tine bodies 222 by a predetermined length.

The bent part 224 is bent into a U shape. Both ends of the bent part 224 are respectively inserted into the extensions 223 for connecting the extensions 223.

The bent part 224 can move into and extend from the extensions 223 by a predetermined length.

Therefore, the length of the bottle tine 220 can be adjusted according to the length of a tableware product such as a bottle to be put on the bottle tine 220.

Alternatively, the bottle tine 220 may include only the tine bodies 222 and the bent part 224 except the extensions 223. In this case, the outer diameter of the bent part 224 corresponds to the inner diameter of the tine bodies 222, and the length of the bottle tine 220 can be adjusted by moving the bent part 224 into or away from the tine bodies 222.

The tine bodies 222 may include lower threaded ends, and the rack body 210 may include threaded portions around the insertion grooves 215 formed in the top surface. In this case, the tine bodies 222 can be more firmly fixed to the rack body 210 by coupling the threaded ends of the tine bodies 210 to the threaded portions of the rack body 210.

As described above, according to the dishwasher of the present invention, tableware products having a long and hollow shape such as milk bottles and feeding bottles can be separately placed on the dish rack in a vertical position.

Further, the space of the dish rack can be more efficiently used by vertically placing hollow and long tableware products on the dish rack.

Furthermore, since the bottle rack is detachably mounted on the dish rack, dishes or bottles can be placed on the dish rack at desired locations.

In addition, since long and hollow tableware products such as milk bottles and feeding bottles are placed upside-down on the dish rack, remainders or dirt can be completely removed.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a dish rack receiving articles; and a bottle rack including a rack body detachably coupled to the dish rack and one or more bottle tines coupled to a top portion of the rack body, adapted to receive articles having a bottle or cup shape, wherein the rack body includes at least two first surfaces and at least two second surfaces and the length of the at least two first surfaces is longer than that of the at least two second surfaces, wherein the at least two first surfaces are substantially parallel, the bottle tines include at least two ends that are coupled to one of the at least two first surfaces, wherein each of the at least two first surfaces defines a plurality of frame inserting grooves in a bottom portion for coupling with the accommodation frames, wherein each of the at least two second surfaces defines an interference preventing groove to receive the accommodation frame to prevent the rack body from interference with the accommodation frame.

2. The dishwasher according to claim 1, wherein the rack body further defines a fixing part located in the frame inserting groove for fixing the rack body to the frame.

3. The dishwasher according to claim 1, wherein the rack body comprises one or more insertion grooves in the top portion thereof at a predetermined interval for receiving the bottle tine.

4. The dishwasher according to claim 1, wherein the rack body comprises an outlet hole for discharging washing liquid fallen from the articles.

5. The dishwasher according to claim 1, wherein the rack body is formed of plastic by injection molding.

6. The dishwasher according to claim 1, wherein the rack body detachably coupled to the dish rack is movable on the dish rack.

7. The dishwasher according to claim 1, wherein the length of the bottle tine is adjustable.

8. The dishwasher according to claim 1, wherein the bottle tine has a reversed U shape.

9. The dishwasher according to claim 1, wherein the bottle tine comprises:

a plurality of tine bodies; and a bent part curved at least one time and slidable with respect to the plurality of tine body to adjust the length of the bottle tine.

10. A dishwasher comprising:

a dish rack including an outer frame and an accommodation frame coupled to the outer frame for forming a bottom surface of the dish rack; and a bottle rack detachably coupled to a bottom surface of the accommodation frame for vertically receiving articles having a bottle or cup shape, wherein the bottle rack includes a rack body forming an exterior of the bottle rack and a bottle tine having both ends coupled to a top portion of the rack body, wherein the rack body includes at least two first surfaces and at least two second surfaces and the length of the at least two first surfaces is longer than that of the at least two second surfaces, wherein each of the at least two second surfaces defines an interference preventing groove to receive the accommodation frame to prevent the rack body from interference with accommodation frame, wherein the rack body is coupled to the plurality of frames in an up and down direction.

11. The dishwasher according to claim 10, wherein the rack body comprises a frame inserting groove in a bottom portion for coupling with the accommodation frame by snap fitting.

12. The dishwasher according to claim 10, wherein the bottle tine comprises:

a pair of tine bodies coupled to the rack body;

an extension movable into and away from the tine bodies; and a bent part movable into and away from the extension.

13. The dishwasher according to claim 10, wherein the bottle tine has a reversed U shape.

14. The dishwasher according to claim 10, wherein the rack body comprises an outlet hole for discharging washing liquid fallen from the articles accommodated on the dish rack.

15. The dishwasher according to claim 10, wherein the rack body is movably mounted on the dish rack.

16. A dishwasher comprising:

a dish rack including an outer frame forming an exterior of the dish rack and an accommodation frame coupled to the outer frame for forming a bottom surface of the dish rack; and a bottle rack detachably coupled to the accommodation frame for vertically receiving articles having a bottle or cup shape, wherein the bottle rack includes a rack body having a frame inserting groove for receiving the accommodation frame, and a bottle tine coupled to a top portion of the rack body, wherein the rack body includes at least two first surfaces and at least two second surfaces and the length of the at least two first surfaces is longer than that of the at least two second surfaces, wherein each of the at least two second surfaces defines an interference preventing groove to receive the accommodation frame to prevent the rack body from interference with accommodation frame, wherein the rack body is coupled to the plurality of frames in an up and down direction.

* * * * *